United States Patent [19]

Richards

[11] Patent Number: 4,995,297

[45] Date of Patent: Feb. 26, 1991

[54] LOCKING RATCHET WRENCH

[76] Inventor: John E. Richards, 16307 Summerwind, Houston, Tex. 77090

[21] Appl. No.: 378,783

[22] Filed: Jul. 12, 1989

[51] Int. Cl.[5] ..... B25B 13/12; B25B 7/14

[52] U.S. Cl. ..... 81/126; 81/145; 81/138; 81/328; 81/362

[58] Field of Search ..... 81/318–325, 81/328, 347, 352–360, 362, 386, 392–393, 129, 129.5, 134–135, 138, 126–127, 142, 145

[56] References Cited

U.S. PATENT DOCUMENTS

| | | | |
|---|---|---|---|
| 419,854 | 1/1890 | Hersey | 81/135 |
| 1,206,947 | 12/1916 | Upson | 81/138 |
| 2,573,421 | 10/1951 | Feiring | 81/318 |
| 3,232,150 | 2/1966 | Allegraud | 81/355 X |
| 3,379,079 | 4/1968 | Cutter | 81/367 |
| 3,817,128 | 6/1974 | Evans | 81/145 |
| 4,281,568 | 8/1981 | Martinmaas | 81/142 X |

*Primary Examiner*—D. S. Meislin
*Attorney, Agent, or Firm*—Neal J. Mosely

[57] ABSTRACT

A locking ratchet wrench has a main body with an elongate handle portion and a stationary jaw at one end and a slotted guideway extending through the stationary jaw. A generally square aperture extends transversely through the stationary jaw and rearwardly from the slotted guideway. A movable jaw having ratchet teeth at its rear end is slidably fitted in the guideway. A locking pawl block is slidably retained for forward and rearward movement within the aperture and has locking teeth at the forward end thereof corresponding to the movable jaw ratchet teeth. A spring at the rear end of the locking pawl block normally urges it forward in the aperture. A movable handle pivotally mounted on the main body has front sides slidably received on each side of the aperture and movably connected to said to the locking pawl block to move it into and out of toothed engagement with the movable jaw ratchet teeth. A jaw control spring connected between the movable jaw and movable handle applies upward pressure on the movable jaw to urge it toward the stationary jaw. A handle return spring connected between the main body and the movable handle normally urges the movable handle pivotally away from the main body handle portion when the handles are not being gripped together.

14 Claims, 2 Drawing Sheets

LOCKING RATCHET WRENCH

BACKGROUND OF THE INVENTION

1. Field of the Invention

This invention relates generally to adjustable wrenches, and more particularly to a locking ratchet wrench which has a stationary jaw and a movable jaw which will automatically fit a variety of nut or bolt sizes and have the recommended wrench clearance on each size and will ratchet in either direction and turn a bolt or nut in either direction without removing the wrench after each turn.

2. Brief Description of the Prior Art

Heretofore, numerous tools including adjustable wrenches, pliers, and vise grips have been designed to fit a variety of bolt sizes by turning a screw or squeezing a handle.

One of the major problems with pliers type devices is that they do not have jaws which contact the bolt parallel to each other at all times. Pliers also require a strong grip.

Adjustable wrenches have to be adjusted to each size of bolt by turning a screw, then moving the hand to the wrench handle to turn the bolt. They also have to be removed from the bolt and replaced on the bolt for the next turn. The adjustable wrenches often lose their adjustment after several turns and require frequent readjustment. The loss of adjustment also increases the risk of the wrench jumping over the corners of the bolt, thus damaging the bolt and increases the risk of injury to the user. When the prior art adjustable wrenches are adjusted, it is difficult to set it to the recommended wrench clearance. If the clearance is too tight it is difficult to remove and replace it on the bolt. The prior art adjustable wrenches must also be readjusted each time the user goes to a different size bolt.

There are several patents which disclose various adjustable wrenches.

Hersey, U.S. Pat. No. 419,854and Cox, U.S. Pat. No. 4,580,468 discloses non-ratcheting adjustable pipe wrenches having a sliding jaw and a pivoting jaw and a sliding jaw and a stationary jaw respectively. The wrench jaws do not have parallel faces and would not be suitable for use on nuts or bolts.

Upson, U.S. Pat. No. 1,206,947 discloses a wrench which must be removed and replaced on the bolt after each turn and is not capable of ratcheting in either direction relative to the bolt to turn the bolt in either direction without removing the wrench.

Feiring, U.S. Pat. No. 2,573,421 discloses a cam actuated pivoted jaw wrench which requires removal and replacement of the head member to use the wrench on different size and shapes of nuts or bolts.

Cutter, U.S. Pat. No. 3,379,079 discloses a clamping and locking wrench having first and second actuating arms rotatably connected together at one end, a rotatable member connected to the arms to open and close the jaws, and a toggle joint locking mechanism connected to the rotatable member to lock the arms in position.

The present invention is distinguished over the prior art in general, and these patients in particular by a locking ratchet wrench which has a main body with an elongate handle portion and a stationary jaw at one end. A movable jaw with ratchet teeth at its rear end is slidably fitted on the main body. A locking pawl block has teeth at the forward end thereof corresponding to the movable jaw ratchet teeth and movable into and out of engagement therewith. A movable handle is pivotally mounted on the main body and connected to the locking pawl block to move it into and out of toothed engagement with the movable jaw.

SUMMARY OF THE INVENTION

Accordingly, it is an object of this invention to provide an adjustable ratcheting wrench that will automatically fit a variety of nut or bolt sizes and have the recommended wrench clearance on each size.

It is another object of this invention to provide an adjustable ratcheting wrench that requires no readjustment.

Another object of this invention is to provide an adjustable ratcheting wrench which will ratchet in either direction and turn a bolt or nut in either direction without removing the wrench after each turn.

Another object is to provide an adjustable ratcheting wrench that does not require a strong grip.

Another object is to provide an adjustable ratcheting wrench that requires only one hand for operation and is as simple to use as pliers.

Another object of this invention is to provide an adjustable ratcheting wrench which reduces nut and bolt damage due to rounding off the corners of the nut or bolt.

A further object of this invention is to provide an adjustable ratcheting wrench which reduces the chances of slipping and scraping the knuckles of the user.

A still further object of this invention is to provide an adjustable ratcheting wrench which is simple in construction, economical to manufacture, safe, reliable and durable in use.

Other objects of the invention will become apparent from time to time throughout the specification and claims as hereinafter related.

The above noted objects and other objects of the invention are accomplished by a locking ratchet wrench having a main body with an elongate handle portion and a stationary jaw at one end and a slotted guideway extending through the stationary jaw. A generally square aperture extends transversely through the stationary jaw and rearwardly from the slotted guideway and a movable jaw having ratchet teeth at its rear end is slidably fitted in the guideway. A locking pawl block is slidably retained for forward and rearward movement within the aperture and has teeth at the forward end thereof corresponding to the movable jaw ratchet teeth. A spring at the rear end of the locking block normally urges the locking pawl block member forwardly in the aperture. A movable handle pivotally mounted on the main body has front sides slidably received on each side of the aperture and movably connected to said to the locking pawl block member to move it into and out of toothed engagement with the movable jaw. A jaw control spring connected between the movable jaw and movable handle applies upward pressure on the movable jaw to urge it toward the stationary jaw. A handle return spring connected between the main body and the movable handle normally urges the movable handle pivotally away from the main body handle portion when the handles are not being gripped together.

When the movable handle is pivoted away from the handle portion, the locking pawl block teeth are disengaged from the movable jaw teeth allowing the jaws to be placed around a nut or bolt and as the movable handle is pivoted toward the handle portion, the jaw control spring applies upward pressure on the movable jaw to bias it to engage the nut or bolt. When the movable handle is pivoted further toward the handle portion, the upward pressure on the movable jaw is maintained and the locking block is urged forward by the locking block spring to engage the locking block teeth with the movable jaw teeth in spring biased relation such that the movable jaw teeth may ratchet vertically relative to the locking block teeth toward the open or closed position. When the movable handle and handle portion are gripped firmly together in the closed position, the locking pawl block is moved forward to securely engage the locking pawl block teeth with the movable jaw teeth such that the movable jaw teeth may ratchet vertically relative to said locking block teeth only toward the closed position to firmly grip the nut or bolt allowing it to be turned in either direction.

When the grip is released, said jaw control spring means maintains upward pressure on the movable jaw and the locking paw block is urged rearward by the movable jaw handle to disengage the locking block teeth from the movable jaw teeth whereby the movable jaw teeth may ratchet vertically relative to the locking pawl block teeth in spring biased relation toward the open or closed position allowing the wrench to be turned in either direction relative to the nut or bolt without removing it such that the jaws will engage the adjacent flat surfaces of the nut or bolt.

DESCRIPTION OF THE PREFERRED EMBODIMENT

Figure 1:
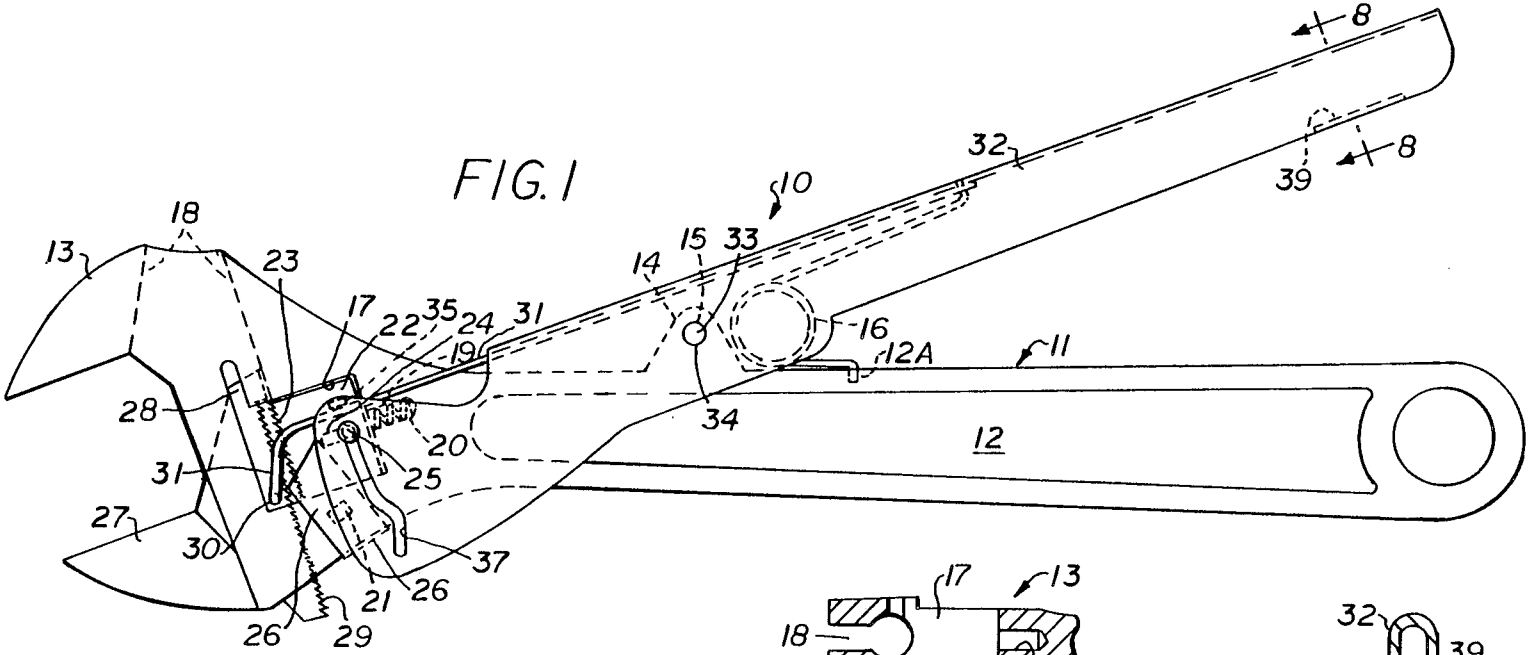
FIG. 1 is a side elevation of a preferred locking ratchet wrench in accordance with the present invention.
Figure 3:
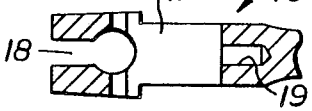
FIG. 3 is a cross section through the stationary jaw portion of the main body.
Figure 2:
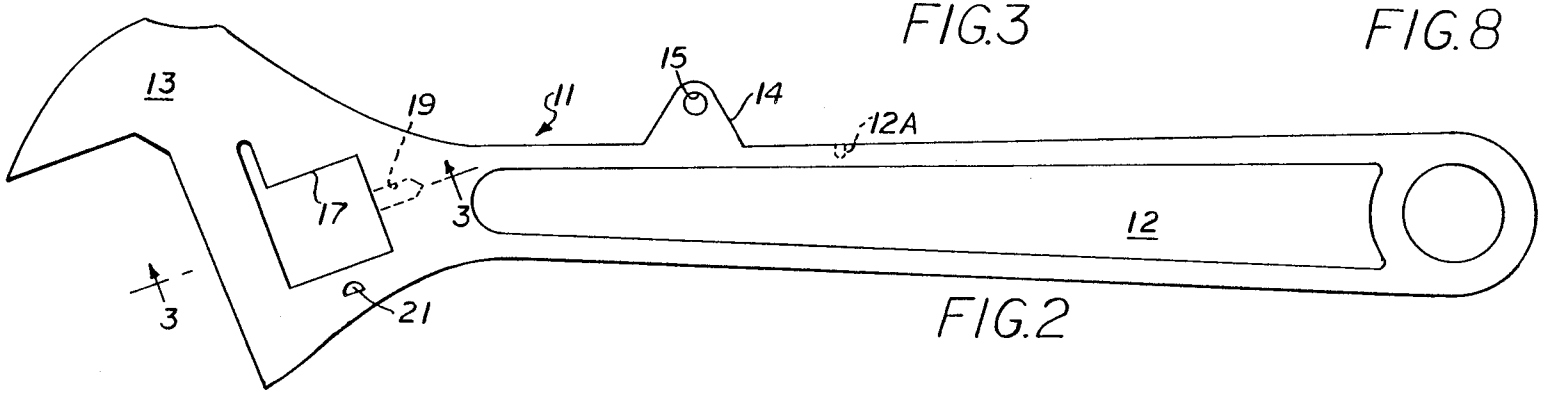
FIG. 2 is a side elevation of the main body of the locking ratchet wrench.

Referring now to the drawings by numerals of reference, there is shown in FIGS. 1, 2, and 3 a preferred locking ratchet wrench 10. The wrench 10 has a main body 11 which has an elongate handle portion 112 and an integral stationary jaw 13 at one end. A raised boss 14 on the handle portion 12 has a transverse hole 15 serving as a pivot point. A recess **12*a* is drilled in the top surface of the handle portion 12 to receive one end of a coiled spring 16. A generally square opening 17 extends transversely through stationary jaw 13 and a slotted guideway 18 extends from opening 17 to the top and bottom surfaces of the stationary jaw 13. A small recess 19 extends inwardly from square opening 17 to receive a compression spring 20. A small indentation 21 is formed on each side of the lower portion of the stationary jaw 13 beneath square opening 17**.

Figure 4:
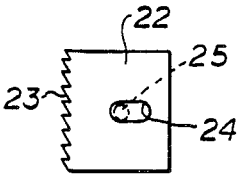
FIG. 4 is a side elevation of the locking pawl block member of the locking ratchet wrench.
Figure 5:
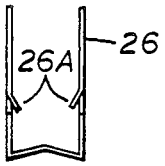
FIG. 5 is a front view of the guide spring which retains the locking pawl block within the stationary jaw portion of the wrench.

Referring additionally to FIGS. 4 and 5, a small flat locking pawl block 22 is slidably received within generally square opening 17 of the stationary jaw 13 and its front surface has teeth 23 formed thereon. A slot 24 extends transversely through the locking pawl block 22 to receive a pin 25. Locking pawl block 22 is held movably within opening 17 by a generally U-shaped guide spring 26 which is a thin flat spring, bent into a U-shape with two prongs **26*a* punched inwardly to snap into the indentations 21 on the stationary jaw 13 when it is pressed thereon on from the bottom. Locking pawl block 22 is urged outwardly from the rear surface of opening 17 by the compression spring 20 engaging its rear surface. The sides of U-shaped spring 26 retain locking pawl block 22 within opening 17**.

Figure 6:
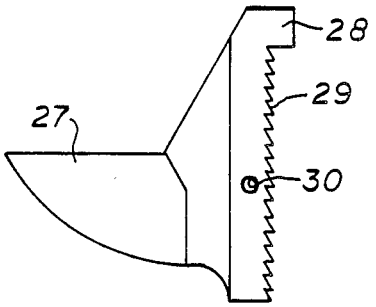
FIG. 6 is a side elevation of the movable jaw member of the locking ratchet wrench.

As shown in FIGS. 1 and 6, movable jaw 27 has a thin flat guide portion 28 at its rear end which is slidably received in the slotted guideway 18 in the stationary jaw 13. The rear surface of the guide portion 28 has ratchet teeth 29 formed thereon which releasably engage the ratchet teeth 23 of the locking pawl block 22 as described hereinafter.

The teeth 29 of the movable jaw 27 and the locking pawl block are longitudinally spaced to correspond to blot and nut sizes. For example, the teeth may be spaced 1/16" apart for bolts using inch dimensions, and 1MM apart for metric bolts. Smaller wrenches may have the teeth spaced 1/32" apart from precise fit on the nut or bolt. The jaw spacing is controlled during manufacture to provide wrench clearance of 0.007" in the locked position whereby the wrench will have the recommended clearance for open ended wrenches.

Figure 7:
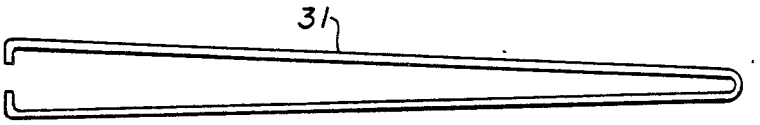
FIG. 7 is a top plan view of the jaw control spring.

A small hole 30 is formed in each side of movable jaw 27 to receive the free ends of an elongate jaw control spring 31 (FIG. 7). Jaw control spring 31 is an elongate U-shaped wire spring having its free ends bent inwardly to be received in holes 30 on each side of the movable jaw 27. The remaining portion of the jaw control spring 31 extends upwardly and rearwardly from the inwardly bent ends along each side of the locking pawl block 22 and the U-shaped elongate portion is received within an elongate movable handle described hereinafter.

An elongate movable handle 32 having an inverted U-shape cross section is movably mounted astride the main body 11 and pivotally mounted thereon by pin 33 received through holes 34 in the sides of the handle 32 and through the hole 15 in the raised boss 14 on the handle portion 12. The elongate U-shaped rear portion of the jaw control spring 31 is biased against the interior upper portion of the movable handle 32. A pair of small inwardly facing tabs 35 on the interior upper portion of the movable handle 32 reside above the jaw control spring 31 and prevent the jaw control spring from bowing excessively during the jaw moving operation and to force the movable jaw 27 open when the handle 32 is allowed to return to the open position.

A coiled handle return spring 16 has one end bent downward to be received in a hole **12*a* in the handle portion 12 with its coiled portion adjacent the raised boss 14 and the free end of the coiled spring is biased against the interior upper portion of the movable handle 32 to normally urge the rear portion of the handle pivotally away from the rear portion of the handle portion 12 of the main body 11** when the handles are not being gripped together.

The movable handle 32 closes the movable jaw 27 by applying upward pressure to its through the control spring 31. The front sides of the inverted U-shaped handle 32 have parallel cam slots 37 formed therein with a radius of curvature equal to the distance from the pin 33 to its own center line. The lower portion of the cam slots are configured in a reverse curve for a distance of about ¼ inch. The locking pawl block pin 25 is slidably received through the slot 24 in the locking block 22 and the outer ends ride in the cam slots 37 on each side of the movable handle. The pin 25 slides horizontally in the slot 24 through the locking block 22. When the pin 24 is maintained in the rear position it holds the locking block teeth 23 clear of the movable jaw teeth 29. When the pin 25 is moved forward by the reverse curve portion of the cam slot 37, it releases the locking block 22, but allows the locking pawl block teeth to ratchet as needed.

When handle 32 is closed, cam slots 37 maintain locking block pin 25 back near the rear of opening 17 in the stationary jaw until the handle is within approximately ½ inch of being fully closed. It then causes locking pawl block pin 25 to pass into the reverse curve portion of the cam slot, thus moving the pin 25 forward. When pin 25 is moved forward, locking pawl block 22 is allowed to move forward and its teeth 23 engage teeth 29 of movable jaw 27 as a multiple pawl for the ratchet structure. This prevents movable jaw 27 from opening but allows it to ratchet toward the closed position by compressing spring 20. As movable handle 32 is closed, jaw control spring 31 closes movable jaw 27 onto a nut or bolt. When movable jaw 27 makes contact with the nut, jaw control spring 31 yields and allows the handle to continue closing, while holding pressure on movable jaw 27.

Figure 8:
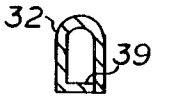
FIG. 8 is a cross section through the movable handle member of the wrench showing the positive stop element.

Movable handle 32 has a positive stop 39 bent transversely across its underside (FIG. 8). The stop 39 makes contact with the top surface of the handle portion 12 of the main body 11 when the movable handle is fully closed. The stop 39 prevents the cam slot 37 from going far enough to bind the pin 25 against the end of the slot.

OPERATION

Figure 9:
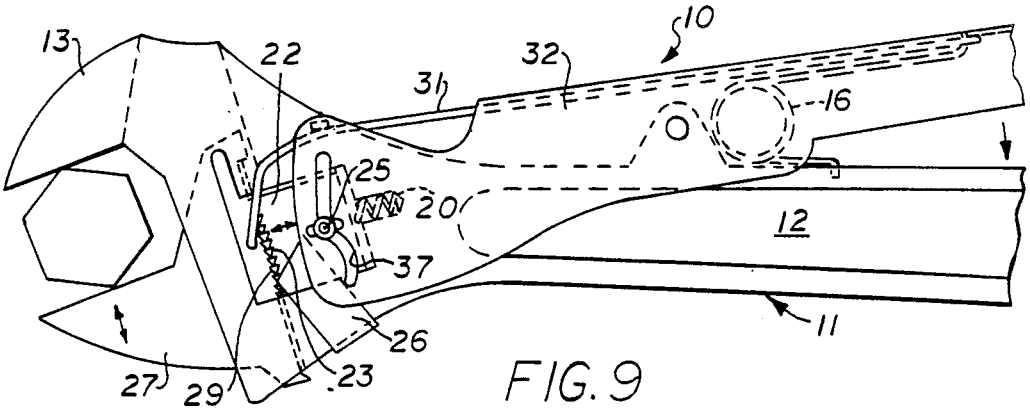
FIG. 9 is a partial side elevation of the locking ratchet wrench in the ratcheting position.
Figure 10:
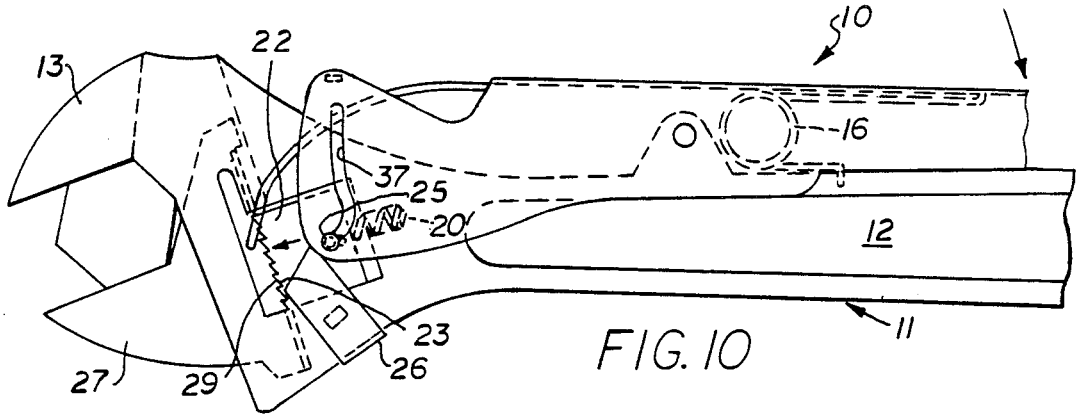
FIG. 10 is a partial side elevation of the locking ratchet wrench in the locked position.

Referring now to FIGS. 1, 9, and 10, the operation of the locking ratchet wrench will be explained. In operation, the user grips the handles 12 and 32 in one hand and places the jaws 13 and 27 around the nut or bolt. As the handles are squeezed together, movable handle 32 closes the movable jaw 27 by applying upward pressure to it through the control spring 31. In this position, the locking pawl block teeth 23 are not yet engaged with the movable jaw teeth 29, since the locking block pin 25 slides horizontally in the slot 24 through the locking block 22. When the pin 25 is maintained in the rear position it holds the locking block teeth 23 clear of the movable jaw teeth 29 (FIG. 1).

As movable handle 32 is closed (FIG. 9), jaw control spring 31 closes movable jaw 27 onto a nut or bolt. When movable jaw 27 makes contact with the nut, jaw control spring 31 yields and allows the handle to continue closing, while holding pressure on movable jaw 27. Also as handle 32 is closing, pin 25 is moved forward by the reverse curve portion of cam slot 37, it releases locking pawl block 22, but allows the locking pawl block teeth 23 to ratchet as needed.

When handle 32 is squeezed closed (FIG. 10), cam slots 37 maintain locking pawl block pin 25 back near the rear of opening 17 in the stationary jaw until the handel is within approximately ½ inch of being fully closed. It then causes locking block pin 25 to pass into the reverse curve portion of the cam slot, thus moving pin 25 forward. When pin 25 is moved forward locking pawl block 22 is allowed to move forward and its teeth 23 engage teeth 29 of movable jaw 27. This prevents movable jaw 27 from opening but allows it to ratchet toward the closed position by compressing spring 20.

Positive stop 39 on the underside of movable handle 32 makes contact with the top surface of handle portion 12 of main body 11 when the movable handle is fully closed. The stop 39 prevents cam slot 37 from going far enough to bind pin 25 against the end of the slot 37. In this position, the nut or bolt may be turned in either direction.

After one turn, it is not necessary to remove the wrench from the nut or bolt as required with most prior art adjustable wrenches. With the present wrench, the user merely opens the movable handle ½ inch and it will ratchet it either direction relative to the nut or bolt with no need to remove it. The teeth of the jaw and the locking block have no contact in this position, so there is no tooth wear.

Thus, the present wrench will automatically fit the nut or bolt and will automatically lock on the nut or bolt with the proper amount of wrench clearance, due to the spacing of the teeth of the movable jaw and locking block. Because the toothed engagement has greater shear strength than a knurled screw common in conventional wrenches, the present wrench retains its adjusted fit, and does not require frequent re-adjustment.

Should the jaws of the wrench be closed down on the corners of the bolt (FIG. 9), as the wrench is moved, the jaws will continue to close due to the jaw control spring until they reach the flats on the nut or bolt and remain locked in this position, and will have the recommended wrench clearance for open ended wrenches. The present wrench eliminates bolt damage due to rounding off the corners of the nut or bolt, as is common with other adjustable wrenches and is safer because it reduces the chances of slipping and scraping the knuckles of the user.

While this invention has been described fully and completely with special emphasis upon a preferred embodiment, it should be understood that within the scope of the appended claims the invention may be practiced otherwise than as specifically described herein.

What is claimed is:

1. A locking ratchet wrench comprising;

a main body having an elongate handle portion with an integral stationary jaw at one end and a slotted guideway extending between the top and bottom surfaces of said stationary jaw, an opening having a rear wall, extending transversely through said stationary jaw and rearwardly from said slotted guideway, a movable jaw slidably fitted in said guideway for movement toward and away from said stationary jaw and having ratchet teeth at the rearward end thereof, a locking pawl block member slidably retained for forward and rearward movement within said opening and having said teeth at the forward end thereof corresponding to said movable jaw ratchet teeth and movable into and out of engagement with said movable jaw ratchet teeth, locking pawl spring means between said opening rear wall and said locking pawl block member to normally urge the same forwardly away from said rear wall, an elongate movable handle pivotally mounted on said main body and having a front portion with sides which are slidably received on each side of said opening and operativly connected to said locking pawl block member to move the same into and out of toothed engagement with said movable jaw, jaw control spring means operatively connected between said movable jaw and said movable handle to apply upward pressure on said movable jaw to urge said movable jaw toward said stationary jaw, and handle return spring means operatively connected between said main body and said movable handle to normally urge the rear portion of said movable handle pivotally away from the handle portion of said main body when the handles are not being gripped together, whereby when said movable handle is pivoted away from said handle portion the teeth of said locking pawl block member are disengaged from the teeth of the movable jaw allowing the jaws to be moved for placing around a nut or bolt, and as said movable handle is pivoted toward said handle portion, said jaw control spring means applies upward pressure on the movable jaw to bias it against a nut or bolt to be turned, and subsequent movement of said movable handle moves said movable jaw toward the closed position to firmly grip the nut or bolt allowing it to be turned in either direction.

2. A locking ratchet wrench according to claim 1 in which said movable handle is operatively connected to said locking pawl block member by a pin extending through a transverse slot in said locking pawl block member and received in parallel cam slots on the front sides of said movable handle which are configured to move said pin horizontally rearward and forward in the transverse slot as said movable handle is pivoted, whereby in the rearward position the pin pulls said locking pawl block rearward to overcome said locking pawl spring means and hold said locking pawl block teeth clear of said movable jaw teeth and when the pin is moved forward said locking pawl block is urged forward by said locking pawl spring means to allow said locking pawl block teeth to ratchet with said movable jaw teeth.

3. A locking ratchet wrench according to claim 1 in which said handle return spring means is a coiled spring having one end engaged on said main body handle portion and its other end engaged on said movable handle.

4. A locking ratchet wrench according to claim 1 in which said opening through said stationary jaw is generally square, and said locking pawl block member is slidably retained within said opening by a U-shaped guide member secured on said stationary jaw with its sides slidably received on each side of said opening and said locking pawl block member to prevent relative lateral movement.

5. A locking ratchet wrench according to claim 1 in which said locking pawl block spring means comprises a small compression spring having one end received in a hole in the rear wall of said opening and its other end engaged on the rear surface of said locking pawl block member.

6. A locking ratchet wrench according to claim 1 in which said movable jaw has a thin flat guide portion at its rear end which is slidably received in said stationary jaw slotted guideway and said ratchet teeth are formed on the rear surface of said guide portion.

7. A locking ratchet wrench according to claim 1 in which said movable jaw teeth and said locking pawl block member teeth are each longitudinally spaced to corresponding to bolt size increments.

8. A locking ratchet wrench according to claim 7 in which said movable jaw teeth and said locking pawl block member teeth are each spaced 1/16" apart corresponding to bolt sizes using inch dimensions.

9. A locking ratchet wrench according to claim 7 in which said movable jaw teeth and said locking pawl block member teeth are each spaced 1/32" apart corresponding to bolt sizes using inch dimensions.

10. A locking ratchet wrench according to claim 7 in which said movable jaw teeth and said locking pawl block member teeth are each spaced 1 MM apart corresponding to bolt sizes using metric dimensions.

11. A locking ratchet wrench according to claim 7 in which the opposed gripping surfaces of said stationary jaw and said movable jaw are machined to provide clearance between the flat surfaces of the nut or bolt when placed thereon and prior to squeezing said handles together corresponding to the wrench clearance of standard open ended wrenches.

12. A locking ratchet wrench according to claim 1 in which said jaw control spring means is an elongate U-shaped wire spring having its free ends bent inwardly and received in small apertures on each side of said movable jaw and the remaining portion of said jaw control spring extending upwardly and rearwardly from the inwardly bent ends along each side of said locking pawl block member and torsionally engaged on said movable handle, whereby when said movable handle is pivoted away from said main body handle portion and said movable jaw teeth and said locking pawl block member teeth are disengaged, said jaw control spring will urge said movable jaw away from said stationary jaw to an open position.

13. A locking ratchet wrench according to claim 1 in which said movable handle has an inverted U-shape cross section and is pivotally mounted astride said main body.

14. A locking ratchet wrench according to claim 1 in which said handle return control spring means is a coiled torsion spring having one end engaged on said main body and its other end engaged on said movable handle to normally urge the rear portion of said movable handle pivotally away from the rear portion of said main body handle portion when said handles are not being gripped together.

* * * * *